United States Patent [19]

Getz

[11] Patent Number: 4,916,840

[45] Date of Patent: Apr. 17, 1990

[54] MODULAR SIGN SYSTEM

[76] Inventor: Alan J. Getz, 6750 W. Loop South, Suite 685, Bellaire, Tex. 77401

[21] Appl. No.: 151,561

[22] Filed: Feb. 2, 1988

[51] Int. Cl.[4] ..... G09F 7/00; G09F 7/02

[52] U.S. Cl. ..... 40/605; 40/611

[58] Field of Search ..... 40/605, 606, 607, 610, 40/611; 206/515

[56] References Cited

U.S. PATENT DOCUMENTS

| | | | |
|---|---|---|---|
| 1,359,659 | 11/1920 | Beans | 40/605 |
| 1,862,776 | 6/1932 | Timberlake | 40/605 |
| 2,559,302 | 7/1951 | Louft . | |
| 2,865,124 | 12/1958 | Mortellito | 40/605 |
| 3,174,629 | 3/1965 | Gellberg et al. . | |
| 3,435,982 | 4/1969 | Sneed | 206/515 |
| 3,537,200 | 11/1970 | Bubb . | |
| 3,719,000 | 3/1973 | Finger . | |
| 3,935,653 | 2/1976 | Klein . . | |
| 4,112,604 | 9/1978 | Ott et al. . | |
| 4,144,664 | 3/1979 | DeKorte . | |
| 4,325,197 | 4/1982 | Achter et al. . | |
| 4,357,772 | 11/1982 | Amick et al. . | |
| 4,524,533 | 6/1987 | Still, Jr. . | |
| 4,604,820 | 8/1986 | Edman | 40/605 |

FOREIGN PATENT DOCUMENTS

| | | |
|---|---|---|
| 2710419 | 3/1977 | Fed. Rep. of Germany . |
| 768730 | 8/1934 | France . |
| 2441124 | 11/1978 | France . |
| 1299642 | 6/1972 | United Kingdom . |

*Primary Examiner*—Richard J. Apley
*Assistant Examiner*—D. F. Crosby
*Attorney, Agent, or Firm*—Arnold, White & Durkee

[57] ABSTRACT

A modular sign system designed for use by real estate agents, remodeling contractors, political candidates and private individuals made up of separate frame modules which are easily transported to the installation site in the trunk or back seat of a normal passenger car. Once on site, the individual modules can be assembled into a completed sign and installed with little effort and no tools. After use, the sign can be broken down into component modules for easy transportation and storage until its next use.

6 Claims, 2 Drawing Sheets

MODULAR SIGN SYSTEM

BACKGROUND OF THE INVENTION

Uses by real estate agents, garden clubs, home owners, retailers, contractors and political candidates generally require that signs be easy to transport, easy to install, attractive, semi-permanent once installed, and still easy to remove and store when they have served their purpose. In the past, such signs have ranged from cheap cardboard signs stapled to posts driven into the ground to large, elaborate and expensive wooden, metal or plastic signs. The former type of sign has the disadvantage of lacking permanence and portraying an unprofessional image. Signs of the second type are either too bulky, heavy and cumbersome to transport readily, or they require a multitude of different pieces and tools, and a large amount of time, skill and effort to assemble on site.

THE PRESENT INVENTION

The object of the present invention is to provide a sign frame which is itself permanent and conveys a permanent professional image when installed on site, but which at the same time can be readily disassembled into prefabricated component modules for carrying by hand, transporting in a normal passenger car, and storage. In a general aspect, the present invention is a prefabricated module comprised of two laterally spaced legs; elongated members which will be upright or vertically disposed in normal service. The two legs are interconnected by two vertically spaced, lateral cross members which join two sets of corresponding points on the two legs. One set of such points—the upper set—will preferably be at the upper ends of the two legs. The other set of points will be spaced above the lower ends of the legs a distance sufficient to enable the lower ends to be inserted into the soil or other suitable base.

The two upright legs and the two lateral crossmembers thus form a rectangular sign frame module. The upper ends of the two legs are configured such that they will receive the lower ends of the legs of a second similar module which may be stacked onto the first module. The second module is supported by its lower lateral crossmember resting on the upper lateral crossmember of the first module.

The sign frame is expandable by merely adding additional prefabricated modules, which in one embodiment are all identical and interchangeable, and the installed size is limited only by the number of prefabricated modules which the soil can adequately support. The individual modules can be pinned or locked together to frustrate vandalism and add structural integrity.

An additional feature is that the lower most module can be normally inserted into the ground by the pressure of the installer's foot on the lower horizontal member. In the event the soil will not easily receive the pointed legs either because it is too hard or the installer is too light, an upper module can be used to drive the lower module into the ground by merely placing it over the lower module, steadying the lower module with one hand and reciprocating the upper module vertically with the other hand. After installation, the upper module that was used as a driver may be left in place or removed as desired.

The party installing the sign never, has to carry tools and has only one or two types of prefabricated modules to keep track of regardless of the ultimate size and complexity of the installed sign.

DETAILED DESCRIPTION OF THE INVENTION

Figure 1:
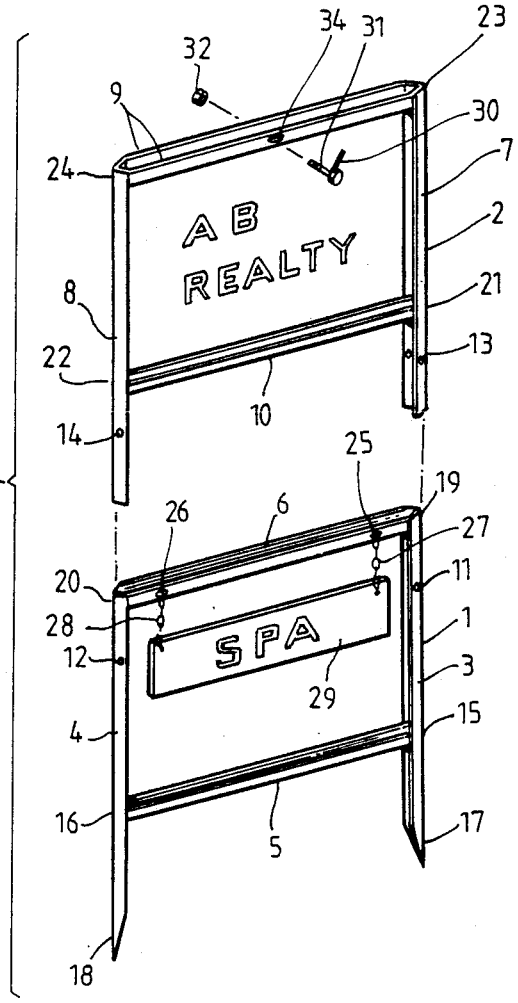
FIG. 1 is an exploded isometric view of a complete sign structure embodiment showing how all the various components would be assembled on site.
Figure 2:
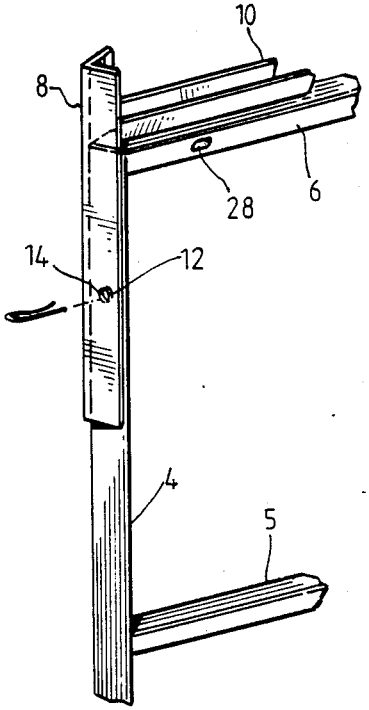
FIG. 2 is a detailed isometric view of the sign structure of FIG. 1 showing how the lower leg of an upper prefabricated module mates with the upper leg of a lower prefabricated module.

Referring now to the drawings in more detail and in particular to FIG. 1 and FIG. 2 it is possible to see the relationship of all the components in one embodiment of the invention.

The lower frame module 1 is comprised of two upright members 3 and 4 with their prefabricated lower ends 17 and 18 pointed to the extent necessary to penetrate the earth for support. The upright members 3 and 4 are connected to the lateral ends 15 and 16 of a lower horizontal member 5, and to the lateral ends 19 and 20 of an upper horizontal member 6.

The upper horizontal member 6 may contain a plurality of holes, illustrated as 25 and 26, which can be used to support a small sign placard 29 by hooks 27 and 28. The upright members 3 and 4 may contain holes 11 and 12, respectively, in their upper positions (the purpose of which will be made apparent later in this specification).

The prefabricated upper frame module 2 is comprised of two upright members 7 and 8, connected by a lower horizontal sign support member 10 at its lateral ends 21 and 22 and connected by an upper horizontal member 9 at its lateral ends 23 and 24.

The upper and lower horizontal members 9 and 10 of the upper frame module 2 are enough longer than the upper and lower horizontal members 5 and 6 of the lower frame module 1 that the inside width of the upper frame module 2 is the same as the outside width of the lower frame module 1. Thus, when the upper frame module 2 is stacked on lower frame module 1, the lower horizontal member 10 of the upper frame module 2 will rest on the upper horizontal member 6 of the lower frame module 1 and the modules will fit together as shown in FIG. 2.

The upper horizontal member 9 of the upper frame module 2 is slotted or otherwise adapted so that a sign placard 30 may be inserted through it into the frame. Once inserted, the sign placard is supported by the horizontal sign support member 10 and laterally restrained by the vertical members 7 and 8 and the upper horizontal member 9. The upper horizontal member 9 may contain a hole 34 through which a restraining device shown as a bolt 31 with nut 32 may be inserted to prevent unintended removal of the sign placard. Although the restraining device is shown as a bolt 31 with nut 32, it can readily be seen that the restraining device could also be a hairpin clip, a cotter pin, a pad lock or any other device which would prevent unintended removal of the sign placard.

The lower portions of the upright members 7 and 8 of upper frame module 2 may contain holes 13 and 14 located such that when the upper and lower frame modules 2 and 1 are assembled, hole 14 in the upper frame module 2 will mate with hole 12 in the lower module 12, as shown in FIG. 2. A restraining device, shown in FIG. 2 as a hairpin clip 33, can be inserted through holes 12 and 14 to add structural integrity to the assembled sign frame. Although not shown in the assembled view of FIG. 2, it can readily be seen that holes shown as 11 and 13 in FIG. 1 would mate in the same way as holes 12 and 14 mate in FIG. 2. It can also be readily seen that the restraining device, shown as hairpin clip 33, could also be a cotter pin, a nut and bolt, a padlock or any number of devices which would prevent unintended separation of the assembled sign frame.

The sign frame may be assembled before installation and installed as a unit or the lower module 1 may be first inserted in the ground and the upper frame module 2 and sign placards 29 and 30, then mounted on the sign frame. In either case, the installation is accomplished by the installer pushing down on the lower frame module 1 so that the lower ends 17 and 18 of its vertical members are inserted into the ground. Additional force can be applied by placing the installer's foot on the lower horizontal member 5 and by placing the upper frame module 2 in the installed position shown in FIG. 2 and reciprocating it vertically against the lower frame module 1 in a hammering fashion.

Figure 3:
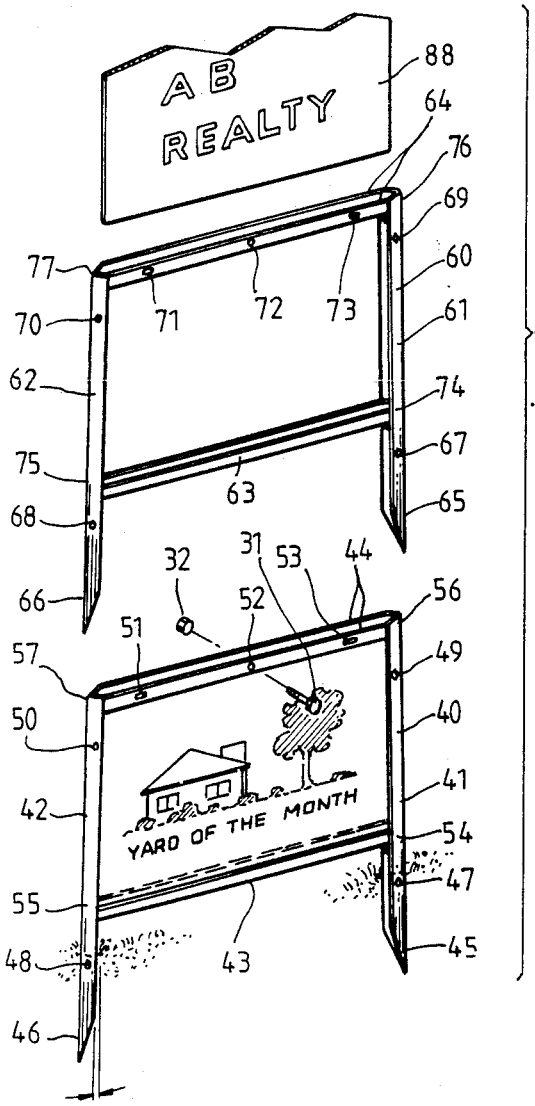
FIG. 3 is an exploded isometric view of a preferred embodiment wherein the individual prefabricated modules are identical and capable of being stacked together by virtue of the fact that the module legs are inclined inward from bottom to top.
Figure 4:
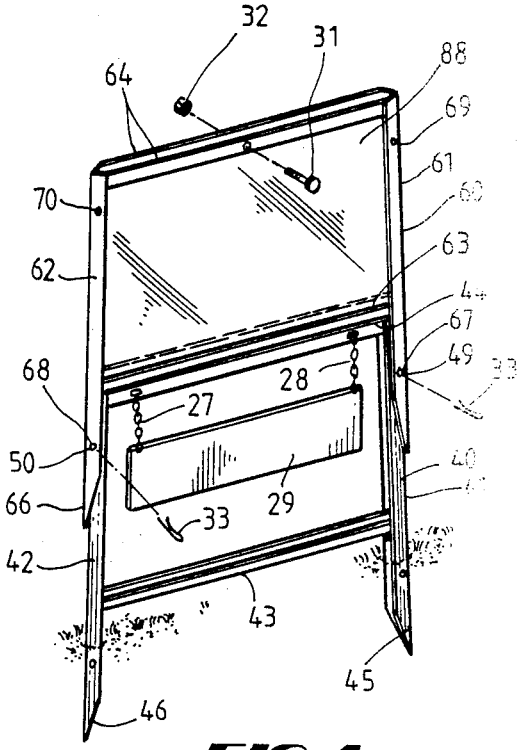
FIG. 4 is a isometric view of a sign structure showing one manner in which the preferred embodiment of FIG. 3 may be assembled.

A preferred embodiment of the invention is shown exploded in FIG. 3 and assembled in FIG. 4. In this embodiment, the upper prefabricated frame module 60 is identical to the lower frame module 40. The lower frame module 40 is comprised of two upright members 41 and 42, whose lower ends 45 and 46, respectively, are configured for easy insertion into the earth and which are connected by a lower horizontal sign support member 43 at points 54 and 55, and an upper horizontal member 44 at points 56 and 57.

The lower horizontal sign support member 43 is longer than the upper horizontal member 44 so that the upright members 41 and 42 incline toward each other at the upper ends.

The upper horizontal member 44 is slotted or otherwise adapted to receive a sign placard 58 which, when inserted through member 44 into the frame module 40, is supported by the lower horizontal sign support member 43 and laterally restrained by upright members 41 and 42, and upper horizontal member 44. The upper horizontal member 44 also contains a plurality of holes (shown as 51, 52 and 53) into any one of which can be inserted a restraining device shown as a bolt 31 with nut 32 to prevent unintended removal of the sign placard 58, or hooks 27 and 28 to support a sign placard 29.

As mentioned before, it can readily be seen that the bolt 31 and nut 32 could be replaced by a cotter pin, a hairpin clip, a padlock or any other device that would prevent unintended removal of the sign placard.

The upright members 41 and 42 may contain holes 47 and 48 in their lower ends and holes 49 and 50 in their upper ends whose function will be explained later in this specification.

Upper module 60, shown in FIG. 3 and FIG. 4, is identical to lower module 40. Therefore, except for the following interrelationship between the two modules 40 and 60 when assembled into a completed sign frame, a detailed description of upper module 60 will be omitted from this specification.

The upright members 61 and 62 of upper module 60 are inclined inwardly toward their upper ends as are the upright members 41 and 42 of lower module 40 such that the inside width from points 74 to 75 of the upper module 60 is the same as the outside width from point 57 to 56 of the lower module 40. Thus, when assembled, the lower female portion of the upper module 60 will mate with the upper male portion of lower module 40 as shown in FIG. 4.

The upright members 61 and 62 of module 60 may contain holes 67 and 68 in their lower ends and holes 69 and 70 in their upper ends located such that in the assembled condition, holes 67 and 68 of upper module 60 will mate with holes 49 and 50, respectively, of lower module 40 to receive a restraining device shown as hairpin clip 33. It will be apparent that the restraining device shown as hairpin clip 33 may as well be a nut and bolt, a cotter pin, a padlock or other device which will add structural integrity to the assembled sign frame and prevent unintended disassembly.

Although, for clarity, FIGS. 3 and 4 show only two prefabricated modules 40 and 60, it will be appreciated that lower frame module 40 or upper frame module 60 may be used alone or in stacked combination with any number of other vertically stacked identical prefabricated frame modules, limited only by the degree of lateral support provided by the lowermost frame module which is inserted in the ground.

Figure 5:
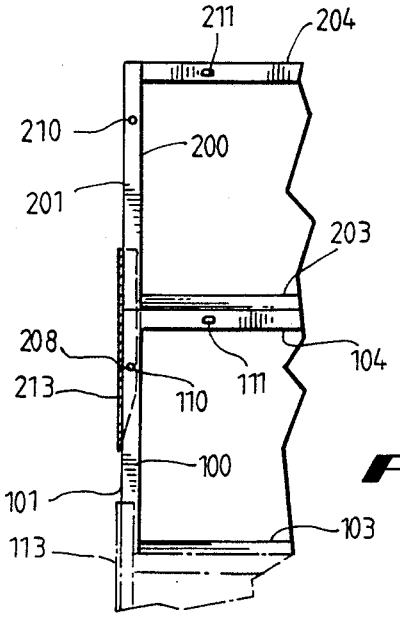
FIG. 5 is an assembled, fragmentary, elevation view of a sign structure showing a second preferred embodiment wherein the individual prefabricated modules are identical but have vertical rather than inclined legs.

FIG. 5 is a partial elevation view of a second preferred embodiment, wherein the upper frame module 200 and the lower frame module 100 are identical. With one exception, the construction, function, assembly and interrelationship of prefabricated frame modules 100 and 200 shown in FIG. 5 are the same as that of prefabricated frame modules 40 and 60 shown in FIGS. 3 and 4. Therefore, only that exception will be described here.

In FIGS. 3 and 4, it is seen that an upper frame module 60 mates with an identical lower frame module 40 by virtue of the fact that the upright members 41, 42, 61 and 62 incline inwardly toward their upper ends, whereas all of the upright members (only 101 and 201 are shown) in the embodiment shown in FIG. 5 are vertical, and all horizontal members 103, 104, 203 and 204 are the same length. The upper module 200 mates with the lower module 100 by virtue of the lower end 213 of upright member 201 being offset or otherwise adapted as shown to slide onto the upper end of upright member 101. Likewise, the lower end 113 of upright member 101 is similarly adapted to slide into an upright member of any other identical module (not shown). It can also be seen that holes 110, 111, 208 and 211 shown in FIG. 5 are comparable to and perform the same function as holes shown in FIGS. 3 and 4 as 50, 51, 68 and 71, respectively.

While the figures show prefabricated frame modules wherein the upright members 1, 4, 7, 8, 41 42, 61, 62, 101 and 201, and the horizontal members 5, 6, 10, 43, 63, 103 and 203 are made of right angle shapes (commonly known as angle iron) and the horizontal members 9, 44, 64, 104 and 204 are made of flat bar stock, it can readily be seen that the frame modules may be constructed of members made from channel shapes, C-shapes, square or rectangular bar stock, box shapes, pipe, split pipe or any number of other common structural shapes. Material for construction would include but not be limited to mild steel, stainless steel, plastic, wood, aluminum, fiberglass reinforced resin and graphite reinforced resin.

Many modifications and variations may be made in the method and apparatus described herein and depicted in the accompanying drawings without departing substantially from the concept of the present invention. Accordingly, the proceeding discussion is exemplary only and is not intended to limit the scope of the present invention.

I claim:

1. A sign frame comprising a plurality of interchangeable prefabricated frame modules which can be stacked together to form a single unit wherein each prefabricated frame module is comprised of:

two upright members each terminating on the lower end in a configuration capable of insertion in the earth and connected by vertically spaced, upper and lower horizontal members to form a generally rectangular structure in a vertical plane;

the lower horizontal member being capable of supporting a sign placard and attached to the upright members at a distance sufficiently above the lower ends of said upright members such that said lower ends may be inserted in the earth for support;

the upper horizontal member being attached to the top of the upright members and adapted to slidably admit a sign placard into the generally rectangular structure formed by the upright and horizontal members; and the upright members being inclined inwardly toward the top such that the lower ends of the upright members of one module will slide over and be received by the upper ends of the upright members of a second such module.

2. A sign frame as described in claim 1, wherein the upright members and the lower horizontal members are made of mild steel in the structural shape known as angle iron and the upper horizontal member is made of mild steel flat bar stock.

3. A sign frame as described in claim 1, wherein the lower end of one or both upright members and the upper end of one or both upright members of a frame module contain holes located such that when two frame modules are stacked together, the hole in the lower end of an upright member on the upper frame module will mate with the hole in the upper end of an upright member on the lower frame module to receive a restraining device and the upper horizontal member contains a plurality of holes located along its length such that said holes can receive restraining devices to prevent the removal of sign placards.

4. A sign frame as described in claim 2, wherein the lower end of one or both upright members and the upper end of one or both upright members of a frame module contain holes located such that when two frame modules are stacked together, the hole in the lower end of an upright member on the upper modular frame will mate with the hole in the upper end of an upright member on the lower frame module to receive a restraining device and the upper horizontal member contains a plurality of holes located along its length such that said holes will receive restraining devices to prevent the removal of sign placards.

5. A modular sign support, comprising:

two laterally spaced, vertically disposed legs of about equal length;

a first laterally disposed crossmember interconnecting the vertically disposed legs at first corresponding intermediate points spaced from the upper and lower ends of the disposed legs;

a second laterally disposed crossmember interconnecting the vertically disposed legs at second corresponding pointed spaced above the first corresponding points to form a four-sided sign frame; and at least a portion of each vertically disposed leg extending up from the lower end thereof toward the first crossmember, and at least a portion of each vertically disposed leg extending down from the upper end thereof, configured to enable the uppermost leg portions of the modular sign support to receive the lowermost leg portions of another such sign support in a sliding, interfitting relation;

wherein said uppermost leg portions are spaced inward from said lowermost portions.

6. A modular sign support, comprising:

two laterally spaced, vertically disposed legs of about equal length;

a first laterally disposed crossmember interconnecting the vertically disposed legs at first corresponding intermediate points spaced from the upper and lower ends of the disposed legs;

a second laterally disposed crossmember interconnecting the vertically disposed legs at second corresponding points spaced above the first corresponding points to form a four-sided sign frame; and at least a portion of each vertically disposed leg extending up from the lower end thereof toward the first crossmember, and at least a portion of each vertically disposed leg extending down from the upper end thereof, configured to enable the uppermost leg portions the module sign support to receive the lowermost leg portions of another such sign support in a sliding, interfitting relation;

wherein said uppermost leg portions and said lowermost leg portions are inclined inwardly.

* * * * *

UNITED STATES PATENT AND TRADEMARK OFFICE

CERTIFICATE OF CORRECTION

PATENT NO. : 4,916,840

DATED : April 17, 1990

INVENTOR(S) : Alan J. Getz

It is certified that error appears in the above-identified patent and that said Letters Patent is hereby corrected as shown below:

Col. 6, line 20, change "pointed" to --points--.

Signed and Sealed this

Twentieth Day of August, 1991

*Attest:*

HARRY F. MANBECK, JR.

*Attesting Officer*

*Commissioner of Patents and Trademarks*